US005665507A

United States Patent [19]

Takagi et al.

[11] Patent Number: 5,665,507

[45] Date of Patent: Sep. 9, 1997

[54] RESIN-COATED CARRIER FOR ELECTROPHOTOGRAPHIC DEVELOPER

[75] Inventors: Masahiro Takagi; Masahito Shinoki; Takayoshi Aoki, all of Kanagawa, Japan

[73] Assignee: Fuji Xerox Co., Ltd., Tokyo, Japan

[21] Appl. No.: 221,982

[22] Filed: Mar. 31, 1994

Related U.S. Application Data

[63] Continuation of Ser. No. 16,201, Feb. 11, 1993, abandoned, which is a continuation of Ser. No. 798,921, Nov. 29, 1991, abandoned.

[30] Foreign Application Priority Data

Nov. 30, 1990 [JP] Japan ..... 2-330632

[51] Int. Cl.[6] ..... G03G 9/00

[52] U.S. Cl. ..... 430/108; 430/904; 428/407

[58] Field of Search ..... 430/108, 904, 430/137

[56] References Cited

U.S. PATENT DOCUMENTS

| | | | |
|---|---|---|---|
| 3,873,355 | 3/1975 | Queener et al. | 430/108 |
| 4,147,831 | 4/1979 | Munzel et al. | 430/108 |
| 4,929,528 | 5/1990 | Shinoki et al. | 430/108 |
| 4,937,166 | 6/1990 | Creatura et al. | 430/108 |
| 5,002,846 | 3/1991 | Creatura et al. | 430/108 |
| 5,059,504 | 10/1991 | Shinoki et al. | 430/108 |
| 5,075,158 | 12/1991 | Kouno et al. | 430/108 |
| 5,100,753 | 3/1992 | Maniar et al. | 430/137 |
| 5,418,102 | 5/1995 | Kotaki et al. | 430/109 |

FOREIGN PATENT DOCUMENTS

| | | | |
|---|---|---|---|
| 51-122449 | 7/1982 | Japan . | |
| 57-122449 | 7/1982 | Japan | 430/108 |
| 62-039880 | 2/1987 | Japan | 430/108 |

*Primary Examiner*—George F. Lesmes
*Assistant Examiner*—Laura Weiner
*Attorney, Agent, or Firm*—Finnegan, Henderson, Farabow, Garrett & Dunner, L.L.P.

[57] ABSTRACT

A magnetic particle brush developing carrier used for electrostatic latent image developing is disclosed, comprising a magnetic particle having a surface coating comprising two kinds of fluoro-type resins, with one of the resins having a higher critical surface tension than the other. The carrier maintains its triboelectric properties even after extended use, it reaches charge saturation after a short period of triboelectrification, and it has excellent charge stability against environmental change.

3 Claims, No Drawings

RESIN-COATED CARRIER FOR ELECTROPHOTOGRAPHIC DEVELOPER

This application is a continuation of application Ser. No. 08/016,201 filed Feb. 11, 1993, now abandoned, which is a continuation of application Ser. No. 07/798,921 filed Nov. 29, 1991, abandoned.

FIELD OF THE INVENTION

The present invention relates to a magnetic particle brush developing carrier with a resin coating layer formed on its surface. The carrier is used for electrostatic latent image developing in electrophotography, electrostatic recording, electrostatic printing, and other like applications.

BACKGROUND OF THE INVENTION

In electrophotography, generally photoconductive materials including selenium are used as a photoreceptor and an electrical latent image is formed by various methods. The latent image is developed with toner which adheres to the latent image. In this developing process, a toner-carrying particle known as "carrier" is used to impart an appropriate quantity of positive or negative triboelectrification to the toner.

In general, a carrier is classified as coated or non-coated, with a coated carrier having superior life when used in the developing process.

Among the different carrier coating materials, a fluoro-type resin can retard toner filming and has excellent resistance to surface contamination because of its low surface energy. However, its adherence to magnetic particles is unsatisfactory, making it difficult to form a continuous and complete coating layer on the carrier which resists damage.

As a result of the unsatisfactory coating, after extended use, changes occur in the carrier's triboelectrification level and its sensitivity to temperature and humidity, causing the premature formation of fog and contamination in the inside of the machine.

SUMMARY OF THE INVENTION

It is therefore an object of the present invention to overcome these and other difficulties encountered in the prior art.

The present invention has been made in view of the above circumstances and has an object to provide an electrophotographic carrier which maintains its triboelectrification properties even after extended use.

A further object of the present invention is to provide an electrophotographic carrier which is capable of reaching charge saturation quickly upon triboelectrification.

Still another object of the present invention is to provide an electrophotographic carrier with excellent charge stability against environmental change.

Additional objects and advantages of the invention will be set forth in part in the description which follows and in part will be apparent from the description, or may be learned by practice of the invention. The objects and advantages of the invention may be realized and attained by means of the instrumentalities and combinations particularly pointed out in the appended claims.

To achieve these and other objects and in accordance with the purpose of the invention, as embodied and broadly described herein, the electrophotographic carrier of this invention comprises a particle composed of a magnetic material having a coating of a first fluoro-type resin and a second fluoro-type resin on its surface.

DETAILED DESCRIPTION OF THE INVENTION

In this invention, the magnetic particle surface is partially coated with a first fluoro-type resin having a relatively low critical surface tension, $\gamma c$, and at least the non-coated surface portion is coated with a second fluoro-type resin having a relatively high critical surface tension to form an overall coating layer on the magnetic particle surface. Tentative liquid surface tension value which becomes $\theta=0°$ when the contact angle of various liquids on a voluntary solid is shown as $\theta$. Critical surface tension is defined when the lim. ($\theta \rightarrow 0°$). Stated otherwise, the critical surface tension is the upper limit of the liquid surface tension value when the solid is completely wet.

The first fluoro-type resin partially coats the carrier particle surface. The second fluoro-type resin coats at least the carrier particle surface which is not coated by the first fluoro-type resin. In the preferred embodiment of the invention, the first fluoro-type resin and second-fluoro type resin coat the entire carrier surface without overlapping each other.

Preferably the first fluoro-type resin has a critical surface tension of less than about 30 dyne/cm, more preferably, about 18 to about 25 dyne/cm. Preferably the second fluoro-type resin has a critical surface tension of less than about 35 dyne/cm, more preferably, about 25 to about 30 dyne/cm. Continuous and complete coating layers inevitably form when the difference between the two critical surface tensions of the two fluoro-type resins is more than about 5 dyne/cm.

Furthermore, using a copolymer comprising vinylidenefluoride as a monomer for at least one of the two kinds of fluoro-type resins imparts sufficient positive triboelectrification to the toner.

In addition, two kinds of fluoro-type resins can be selected to adjust the quantity of triboelectrification and to influence the effects of temperature, humidity, etc., on the carrier.

The first fluoro-type resin for forming the carrier coating layer of present invention may be a homopolymer such as polymers of vinylidenefluoride, trifluoroethylene, tetrafluoroethylene, and hexafluoropropylene monomers, or a copolymer including two or more of these monomers. Particular copolymers which include vinylidenefluoride monomer, are copolymers of vinylidenefluoride-trifluoroethylene, vinylidenefluoride-tetrafluoroethylene and vinylidenefluoride-hexafluoropropylene monomers. Preferably the above-described copolymer contains more than about 50 parts by weight of polyvinylidene fluoride monomer.

To impart sufficient positive triboelectrification to the toner and to maintain satisfactory triboelectrification over a long period of service, it is preferable for the carrier coating to include from about 70 to about 90 weight percent of vinylidenefluoride monomer.

Furthermore, the second fluoro-type resin can contain a functional group in its chemical structure. Representative copolymers containing a functional group are tetrafluoroethylene-vinyl ether copolymer, monochlorotrifluoroethylene-vinyl chloride copolymer, ethylene-tetrafluoroethylene copolymer, a fluorine-type epoxy resin, a fluorine-type polyamide resin, and the like. Preferably the above-described copolymer has less than about 50 weight percent, more preferably about 10 to about 45 weight percent of the fluoro-type monomer.

The carrier of the present invention can be composed of magnetic materials such as iron powder, iron oxide powder, carbonyl iron powder, magnetite, nickel, and all ferrite powders. The preferred average diameter of the carrier core particle is from about 10 to about 500 microns.

There are two methods for applying the fluoro-type resin to the magnetic particle. The first method is to dip the magnetic particle into the fluoro-type resin which is dissolved in a solvent, and the second method is to spray the fluoro-type resin dissolved in a solvent onto the magnetic particle which is fluidized in a fluidized bed coating apparatus.

The first-fluoro type resin has a low critical surface tension. It can be applied to partially coat the carrier surface by using a coating solvent having relatively low solubility for the first fluoro-type resin, or by keeping the coating solution concentration less than about 5 weight percent, preferably between about 0.1 to about 5 weight percent based on the weight of the coated particle.

A reticular coating is formed by drying the magnetic particle after applying the coating solution to the particle surface and removing solvent from the solution. Ketone type solvents such as methyl isobutyl ketone, methyl ethyl ketone, and the like, or dimethylformamide are preferably used for the first fluoro-type resin coating solvent.

Next, the second coating layer which completes the covering of the magnetic surface is formed by using a second fluoro-type resin with relatively high critical surface tension. The second fluoro-type resin is dissolved in a solvent which does not dissolve the first fluoro-type resin. This solution is applied to the above-described reticular coating, and then the solvent is removed and the surface is dried. Aromatic hydrocarbon-type solvents such as toluene, xylene, and the like, are preferably used for the second fluoro-type resin coating solvent. The total coating quantity of the two fluoro-type resins is preferably from about 0.5 to about 3.0 weight percent based on the weight of the coated particle.

The carrier is used in the present invention as a electrostatic latent image developer by mixing it with toner. Any toner with a positive triboelectrification property with colorant dispersed in the binding resin may be used.

EXAMPLE 1

The coating solution is prepared by dissolving 4 parts by weight of vinylidenefluoride-hexafluoropropylene copolymer (80/20 ratio by weight, $_{\gamma}c$=23.1 dyne/cm) in 100 parts by weight of dimethylformamide, next fluidizing 500 parts by weight of iron oxide powder having a 100 micron average particle diameter in a fluidized bed coating apparatus, and then spraying the coating solution and removing the solvent, to obtain an intermediate carrier product. The intermediate product was observed by scanning electron microscopy (SEM), reconfirming that a reticular coating was formed on the iron oxide powder surface.

Next, the carrier was obtained by dissolving 5 parts by weight of tetrafluoroethylene-vinyl ether copolymer (50/50 ratio by weight, $_{\gamma}c$=29.5 dyne/cm) in 50 parts by weight of xylene, and then spraying the coating solution on the intermediate carrier product surface in the above-described fluidized bed coating apparatus and removing the solvent. The carrier was observed by SEM, reconfirming that the iron oxide surface was completely coated with the fluoro-type resin.

EXAMPLE 2

The coating solution was prepared by dissolving 5 parts by weight of vinylidenefluoride-trifluoroethylene copolymer (85/15 ratio by weight, $_{\gamma}c$=23.8 dyne/cm) in 150 parts by weight of dimethylformamide and fluidizing 500 parts by weight of ferrite powder having an 80 micron average particle diameter in the fluidized bed coating apparatus, spraying the coating solution onto the ferrite powder, removing the solvent, and then drying, to obtain the intermediate carrier product. The intermediate product was observed by SEM, reconfirming that a reticular coating was formed on the ferrite powder surface.

The carrier was obtained by dissolving 5 parts by weight of tetrafluoroethylene-vinyl ether copolymer (50/50 ratio by weight, $_{\gamma}c$=29.5 dyne/cm) in 50 parts by weight of xylene, spraying the coating solution onto the surface of the intermediate carrier product in the fluoridized bed coating apparatus, and removing the solvent. The carrier was observed by SEM, reconfirming that the ferrite powder surface was completely coated with the fluoro-type resin.

COMPARATIVE EXAMPLE 1

The intermediate carrier product was obtained by preparing coating solution by dissolving 5 parts by weight of vinylidenefluoride-trifluoroethylene copolymer (85/15 ratio by weight, $_{\gamma}c$=23.8 dyne/cm) in 50 parts by weight of cyclohexanone and fluidizing 500 parts by weight of spheric ferrite powder having an 80 micron average particle diameter in the fluidized bed coating apparatus, spraying the coating solution onto the ferrite powder, removing solvent and then drying. The carrier was observed by SEM, reconfirming that the coating was formed on almost the entire ferrite powder surface.

COMPARATIVE EXAMPLE 2

The coating solution was prepared by dissolving 10 parts by weight of tetrafluoroethylene-vinyl ether copolymer (50/50 ratio by weight, $_{\gamma}c$=29.5 dyne/cm) in 50 parts by weight of xylene and fluidizing 500 parts by weight of spheric iron oxide powder having a 100 micron average particle diameter in the fluidized bed coating apparatus, spraying the coating solution onto the spheric iron oxide powder, removing the solvent and then drying, to obtain the carrier. The carrier was observed by SEM, reconfirming that the coating was formed on almost the entire spheric iron oxide powder surface.

COMPARATIVE EXAMPLE 3

The coating solution was prepared by dissolving 4 parts by weight of vinylidenefluoride-hexafluoropropylene copolymer (80/20 ratio by weight, $_{\gamma}c$=23.1 dyne/cm) in 100 parts by weight of dimethylformamide and fluidizing 500 parts by weight of spheric iron oxide powder having a 100 micron average particle diameter in the fluidized bed coating apparatus, spraying the coating solution onto the spheric iron oxide powder and then removing solvent, to obtain the intermediate carrier product. The intermediate product was observed by SEM, reconfirming that a reticular coating was formed on the spheric iron oxide powder surface.

Next, the carrier was obtained by dissolving 5 parts by weight of perfluorohexylethylmethacrylate ($_{\gamma}c$=20 dyne/cm) in 50 parts by weight of trifluorotrichloroethane, spraying the coating solution onto the intermediate carrier product surface in the fluidized bed coating apparatus, removing the solvent, and then drying. The carrier was observed by SEM, reconfirming that a portion of the iron oxide powder surface was non-coated.

Next, the developer was prepared by mixing 3 parts by weight of toner having a positive triboelectrification property which was made from 100 parts by weight of styrene-butylacrylate copolymer (50/50 ratio by weight), 10 parts by weight of carbon black, and 2 parts by weight of nigrosine type charge control agent (Bontron N-04, made by Orient Chemical Co., Ltd.) with 100 parts by weight of the carrier described in Examples 1 and 2 and Comparative Examples 1, 2 and 3.

The developer was subjected to a continuous copying test using a FX 1065 copying machine having an organic photoconductor belt, producing the following results.

| | Initial Quantity of Triboelectrification (μc/g) | Quantity of Triboelectrification after 100,000 copies (μc/g) | Contamination in the inside of the machine | Influence of temperature and humidity | Developer Life |
|---|---|---|---|---|---|
| Example 1 | 24 | 19 | 0 | small | more than 100,000 copies |
| Example 2 | 21 | 18 | 0 | small | more than 100,000 copies |
| Comparative Example 1 | 17 | 31 | 0 | great | more than 60,000 copies |
| Comparative Example 2 | 25 | 4 | X | small | more than 10,000 copies |
| Comparative Example 3 | 20 | 6 | X | great | more than 50,000 copies |

1. Quantity of triboelectrification was measured by a blow-off measuring apparatus.
2. Peeling of the coating material was observed by SEM.
3. Developer life was estimated when solid density 1.0 of the document was less than 0.7 and the background density was less than 0.03.

The developer of the Examples of the present invention had high triboelectrification initially. Furthermore, the developer was stable and showed only a slight decline after 100,000 copies were made, it was only slightly influenced by temperature and humidity during the testing period, and a limited amount of contamination formed inside of the machine. The carrier of the Comparative Examples in which the magnetic particle was coated with only a single layer of fluoro-type resin exhibited deterioration in its triboelectrification properties after extended use, lacked charge stability against environmental change, and formed more than a limited amount of contamination inside of the copying machine. Accordingly, the developer life of the Comparative Examples was short.

It was also observed that although the magnetic particle surface of the Comparative Examples was almost completely coated, the coating was destroyed in the testing process because it was unstable.

The foregoing description of preferred embodiments of the invention has been presented for purposes of description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A carrier for an electrophotographic developer, comprising:

(a) a particle composed of a magnetic material;

(b) a first fluoro resin coating adhered to only a portion of the particle surface and forming a reticular coating thereon; and (c) a second fluoro resin coating adhered to the particle surface on a portion other than the portion on which the first fluoro resin is adhered wherein the first and second fluoro resin coatings do not overlap each other;

wherein the critical surface tension of the second fluoro resin is more than 5 dynes/cm greater than the critical surface tension of the first fluoro resin;

said first fluoro resin coating consisting essentially of a vinylidenefluoride-trifluoroethylene copolymer, a vinylidenefluoride-tetrafluoroethylene copolymer, or a vinylidenefluoride-hexafluoropropylene copolymer; and said second fluoro resin coating consisting essentially of a tetrafluoroethylene-vinyl ether copolymer, a monochlorotrifluoroethylene-vinyl chloride copolymer, or an ethylene-tetrafluoroethylene copolymer.

2. The carrier of claim 1, wherein said first fluoro resin contains from 70 to about 90 weight percent of vinylidenefluoride monomer.

3. The carrier of claim 1, wherein the quantity of the two fluoro resins totals from about 0.5 to about 3.0 weight percent based on the weight of the coated particle.

* * * * *